United States Patent [19]

Ewing et al.

[11] Patent Number: 4,538,217

[45] Date of Patent: Aug. 27, 1985

[54] FLOODLIGHT LUMINAIRE

[75] Inventors: Robert L. Ewing, Newark; James S. Hughes; Bruce Bruggeman, both of Columbus, all of Ohio

[73] Assignee: Manville Service Corporation, Denver, Colo.

[21] Appl. No.: 533,322

[22] Filed: Sep. 16, 1983

[51] Int. Cl.[3] ..... F21V 17/00

[52] U.S. Cl. ..... 362/375; 362/220; 362/223; 362/269; 362/287; 362/307; 362/310; 362/362; 362/372; 362/427

[58] Field of Search ..... 362/375, 372, 362, 269, 362/220, 223, 287, 307, 310, 427

[56] References Cited

U.S. PATENT DOCUMENTS

| | | | |
|---|---|---|---|
| 716,595 | 12/1902 | Taussig | 362/427 X |
| 2,816,216 | 12/1957 | Dasher | 362/364 |
| 3,755,665 | 8/1973 | Grindle | 362/374 X |
| 3,778,609 | 12/1973 | Liberman | 362/364 |

*Primary Examiner*—Stephen J. Lechert, Jr.
*Attorney, Agent, or Firm*—John D. Lister; Cornelius P. Quinn

[57] ABSTRACT

A flood light luminaire having all of the electrical components mounted on a removable door casting.

3 Claims, 4 Drawing Figures

FLOODLIGHT LUMINAIRE

BACKGROUND OF THE INVENTION

This invention relates generally to floodlight luminaires and more specifically to the mounting of all the electrical components of a floodlight luminaire on a removable doorcasting.

After a luminaire is installed, the new luminaire will require maintenance and servicing now and then. In order to facilitate the maintenance and servicing of the luminaire, it is necessary that the lamp and the electrical components are readily accessible for replacement or repair. Previously, known luminaires have had electrical components in the lamp mounted inside the housing portion of the luminaire making it somewhat difficult for the maintenance or service man to have ready access to them. Relamping was difficult and individual electrical components had to be individually unfastened from the housing section.

It is an object of the present invention to provide ready access in the luminaire for the servicing and maintenance of the various electrical components.

It is another object of this invention to mount the lamp and all of the elctrical components onto the luminaire door.

It is another object of the present invention to partially shield the electrical components from direct heat of the lamp.

SUMMARY OF THE INVENTION

The present invention avoids the disadvantages of prior art luminaires, enabling the relamping and maintenance and servicing of the electrical components in a luminaire to be performed easily and efficiently. In the present invention, the lamp socket and all of the electrical components of the luminaire, are mounted on the door casting. For relamping, the door may be swung outward providing ready access to the lamp. Th electrical circuit may be unplugged from the housing by the disconnect plug and receptacle provided, and the total door, lamp and electrical assembly can then be removed from the luminaire housing by sliding the door sideways to disengage the hinge pins on the door from bosses on the housing. The door can then be removed to a convenient place for any further servicing or maintenance required. Another advantage of mounting the electrical components on the door of the luminaire, is that the door may then be canted outwardly whereby the electrical components are partially shielded from the direct heat of the lamp and the housing section may be canted forward in the same direction providing the luminaire with a more pleasing and overall slimmer appearance.

DESCRIPTION OF THE PREFERRED EMBODIMENT

Figure 1:
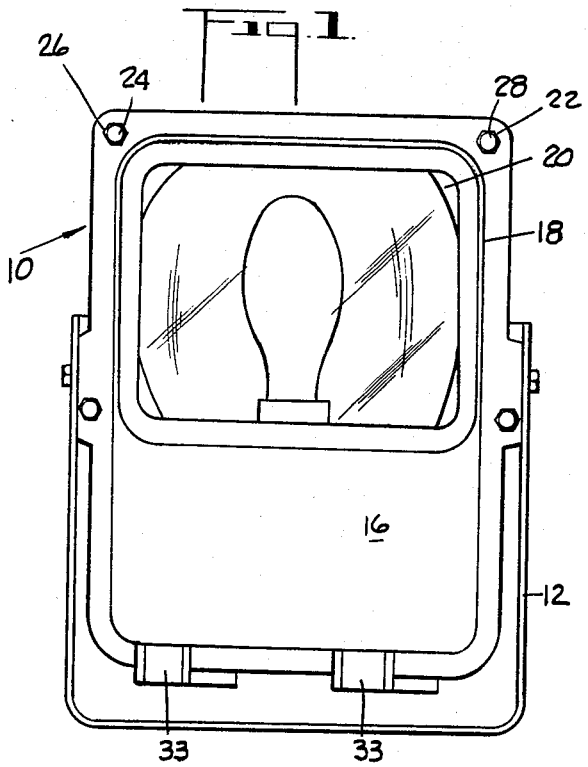
FIG. 1 is a front elevation view of the floodlight luminaire showing the lamp inside the closed luminaire.
Figure 3:
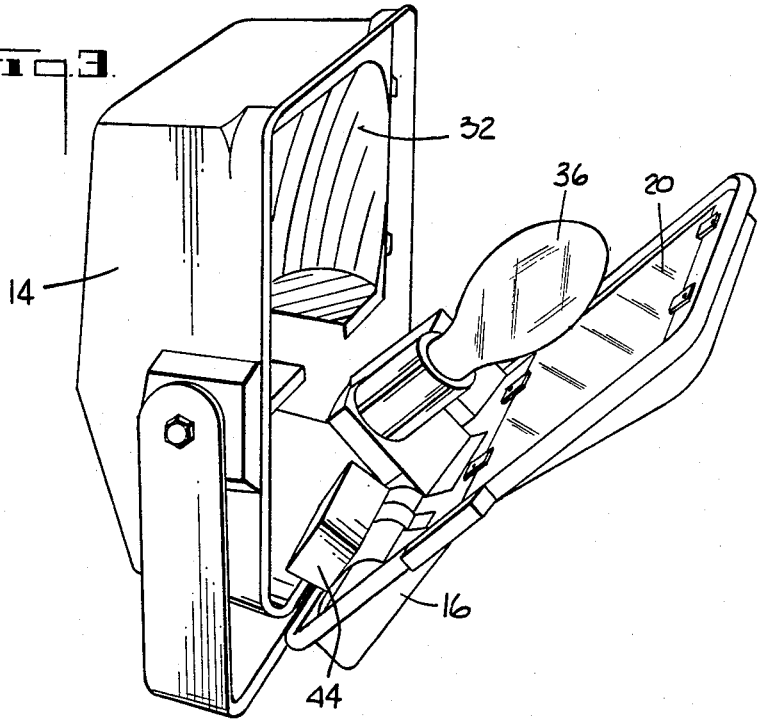
FIG. 3 is a perspective view of the floodlight luminaire with the luminaire door partially open.

Referring now to the drawings, a floodlight luminaire in accordance with this invention, is generally identified by the reference numeral 10. Luminaire 10 is supported by a U-shaped bracket 12 in such a manner that the luminaire may be pivoted about the bracket and adjusted to the desired position. The luminaire 10 has a die-cast housing 14 to which a die-cast door 16 is pivotedly mounted by means of a pair of hinge pins 31 on the door 16 which engage bosses 33 found on the housing. The door 16 has an opening 18 in which is fitted a rugged glass lens 20, gasketed to keep out moisture, dirt and bugs. A pair of fastners 22 and 24 project through a pair of holes 26 and 28 formed in the door 16 into locking engagement with the housing 14 thereby providing a means to lock the door 16 in a closed position as shown in FIG. 1 and to provide access to the interior of the housing 14 as illustrated in FIGS. 3 and 4.

Figure 2:
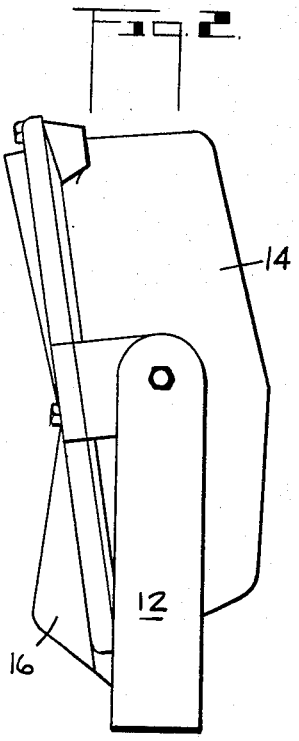
FIG. 2 is a side view of the floodlight luminaire illustrated in FIG. 1 showing the housing section and lower portion of the luminaire door canted forward.
Figure 4:
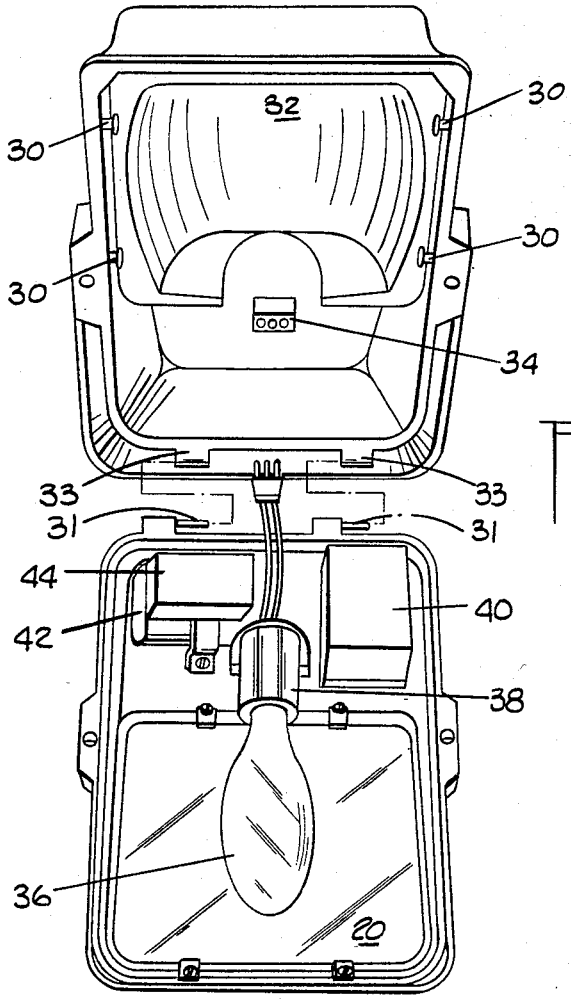
FIG. 4 is a front perspective view illustrating the detachment of the luminaire door from the luminaire housing.

As illustrated in FIG. 2 and FIG. 4, a reflector 32 is fixedly attached to the housing by a number of mounting screws 30. The only other component other than the luminaire door 16 supported by the housing 14, is an electrical connector 34 which provides power from a power supply (not shown). As illustrated in FIG. 4, a lamp 36 and a socket 38 is shown mounted on the luminaire door 16 so that when theluminaire door 16 is swung open, a maintenance man can easily relamp the luminaire. In addition to the electrical lamp socket 38, a ballast 40, a capacitor 42 and a starter 44 are also mounted on the luminaire door 16. In addition to these electronic components, any other components could be mounted on the door as well. As illustrated in FIG. 2 and FIG. 3, the lower portion of the door 16 is canted outwardly providing a recess in the door for mounting the electrical components. The electrical components are thereby partially shielded from the direct heat of the lamp, thereby significantly increasing the life of the components. By canting the luminaire door 16 forward, it is also possible to cant the rear portion of the housing 14 forward to provide a slimmer and more pleasing appearance to the luminaire as a whole.

In operation access to the interior of the housng to relamp or service electrical components of the luminaire 10 is achieved by releasing the fasteners 22 and 24 and pivoting the luminaire door 16 outwardly from the housing 14. This allows the lamp 36 to be easily removed from it's socket 38 and replaced with a new lamp.

In instances where service or maintenance of an electrical component such as the ballast 40, the starter 44 or capacitor 42 is required, it is recommended that the wire to the lamp be disconnected from the electrical connector 34 and then sliding the luminaire door 16 sideways to disengage the hinge pins 31 from bosses 33 on the housing. This completely removes the luminaire door 16 from the luminaire housing 14 allowing it to be taken to a convenient work area for maintenance and servicing.

As will be apparent to persons skilled in the art, variousmodifications, adaptations and variations of the foregoing specific disclosure can be made without departing from the teachings of this invention.

We claim:

1. A luminaire comprising a housing, a luminaire door, pivotedly and detachably mounted on said housing, a reflector fixedly attached in the interior of said housing; a lamp socket and lamp mounted on said luminaire door, and electrical components of said luminaire mounted on said luminaire door below said lamp socket; an opening in said luminaire door with a lens covering said opening.

2. A luminaire as defined in claim 1 wherein said luminaire door is canted outward to receive said electrical components below said lamp socket.

3. A luminaire as defined in claim 2 wherein the back lower portion of said housng is canted forward.

* * * * *